US011358854B2

(12) United States Patent
Bourke

(10) Patent No.: US 11,358,854 B2
(45) Date of Patent: Jun. 14, 2022

(54) PACKAGE

(71) Applicant: Liquid Intellect International Pty. Ltd., Black Rock (AU)

(72) Inventor: Damian Bourke, Bonbeach (AU)

(73) Assignee: Liquid Intellect International Pty. Ltd., Black Rock (AU)

( * ) Notice: Subject to any disclaimer, the term of this patent is extended or adjusted under 35 U.S.C. 154(b) by 0 days.

(21) Appl. No.: 16/306,426

(22) PCT Filed: Jun. 2, 2017

(86) PCT No.: PCT/AU2017/050533
§ 371 (c)(1),
(2) Date: Nov. 30, 2018

(87) PCT Pub. No.: WO2017/205930
PCT Pub. Date: Dec. 7, 2017

(65) Prior Publication Data

US 2019/0210860 A1 Jul. 11, 2019

(30) Foreign Application Priority Data

Jun. 3, 2016 (AU) ..... 2016902143

(51) Int. Cl.
*B67D 1/08* (2006.01)
*B67D 3/04* (2006.01)
(Continued)

(52) U.S. Cl.
CPC ..... *B67D 1/0804* (2013.01); *B65D 5/4608* (2013.01); *B65D 5/541* (2013.01);
(Continued)

(58) Field of Classification Search
CPC .. B67D 1/0804; B67D 3/0067; B65D 77/067; B65D 5/4608; B65D 5/541; B65D 5/542
See application file for complete search history.

(56) References Cited

U.S. PATENT DOCUMENTS 2,946,494 A * 7/1960 Kuss ..... B65D 5/445 229/117.3
3,400,866 A 9/1968 Fattori
(Continued)

FOREIGN PATENT DOCUMENTS

CN 204416066 U 6/2015
WO 2006/096510 A1 9/2006
WO 2009-154092 A1 12/2009

OTHER PUBLICATIONS

International Search Report issued in International Application No. PCT/2017/050533 dated Sep. 18, 2017, 8 pages.
(Continued)

*Primary Examiner* — Jeremy Carroll
(74) *Attorney, Agent, or Firm* — Bochner IP, PLLC; Serge Krimnus

(57) ABSTRACT

The invention relates to a package comprising a carton and a flexible bag to contain a flowable product, the bag having a dispensing outlet for dispensing the flowable product, the carton having an internal wall defining to one side of the wall a first cavity within the carton for locating the bag, the internal wall having an opening within which a body of the dispensing outlet is located whereby an outer end of the dispensing outlet lies within a second cavity defined between an opposite side of the internal wall and an adjacent external wall of the carton, the carton including a removable area leading into the second cavity to expose the dispensing outlet and provide access thereto.

7 Claims, 11 Drawing Sheets

(51) Int. Cl.

| | |
|---|---|
| ***B65D 77/06*** | (2006.01) |
| ***B65D 5/468*** | (2006.01) |
| ***B65D 5/54*** | (2006.01) |
| ***B67D 3/00*** | (2006.01) |
| ***B67D 1/04*** | (2006.01) |

(52) U.S. Cl.

CPC ..... *B65D 5/542* (2013.01); *B65D 77/067* (2013.01); *B67D 1/04* (2013.01); *B67D 1/08* (2013.01); *B67D 3/00* (2013.01); *B67D 3/0067* (2013.01); *B67D 3/0083* (2013.01); *B67D 3/04* (2013.01); *B67D 2001/0827* (2013.01)

(56) References Cited

U.S. PATENT DOCUMENTS

| | | | | | |
|---|---|---|---|---|---|
| 4,645,100 | A * | 2/1987 | Wells | B67D 3/042 | 222/505 |
| 4,919,306 | A * | 4/1990 | Heaps, Jr. | B65D 77/061 | 222/105 |
| 5,074,429 | A | 12/1991 | Konkel et al. | | |
| 5,562,227 | A * | 10/1996 | Takezawa | B65D 5/5021 | 229/117.13 |
| 6,003,742 | A | 12/1999 | Garcia et al. | | |
| 6,454,134 | B1 * | 9/2002 | Aujesky et al. | | |
| 6,561,386 | B1 * | 5/2003 | Martens | | |
| 9,193,512 | B2 * | 11/2015 | Brooks | B65D 77/067 | |
| 9,533,814 | B2 * | 1/2017 | Brooks | B67D 3/04 | |
| 2006/0243783 | A1 * | 11/2006 | Spivey, Sr. | B65D 5/4208 | 229/117.3 |
| 2008/0277417 | A1 * | 11/2008 | Groesbeck | B65D 5/4204 | 222/105 |
| 2009/0283579 | A1 | 11/2009 | Kelly | | |
| 2011/0266287 | A1 | 11/2011 | Groesbeck | | |
| 2015/0041494 | A1 * | 2/2015 | Brooks | B65D 77/067 | 222/105 |
| 2015/0108165 | A1 * | 4/2015 | Merner | B65D 77/067 | 222/105 |

OTHER PUBLICATIONS

Office Action issued in No. 201780043259.6, China National Intellectual Property Administration, dated Oct. 8, 2019.

Office Action issued in No. 201780043259.6, China National Intellectual Property Administration, dated Aug. 4, 2020.

Office Action issued in No. 178054102, European Patent Office, dated Jun. 29, 2020.

Office Action issued in No. HKI-3-HI.05.02.01.PID201811296-TA, Ministry of Law and Human Rights of the Republic of Indonesia Directorate General of Intellectual Property, dated Dec. 7, 2020.

* cited by examiner

PACKAGE

The invention relates to a package and more particularly to a package having a carton and a flexible bag with a spout.

Large plastic water bottles, having a capacity of up to 19 Litres, are used to supply drinking water to workplaces and the like. These plastic bottles cannot be stacked efficiently and must be transported in large customized racks. Once used, the bottles must be transported back to a recycling plant for cleaning, requiring almost the same transport costs whether empty or full. The cleaning process for these bottles requires about 5 Litres of super heated water and chemicals adding to additional costs, further water usage as well as introducing environmental issues. The bottles are expensive and any damaged or mis-placed bottles must be replaced at cost to the customer. Moreover, the bottles are heavy and awkward to use when exchanging empty bottles for full when used with a cooling and water dispensing system as would typically be the case.

Cardboard cartons housing flexible collapsible bags with spouts, known informally as bag-in-box, can also be used to store and dispense drinking water: the area required for storage would typically be significantly less than that of the large plastic bottles discussed above. A perforated area, known as a flap, in the carton can be removed to access the spout. However, users may find it difficult locating the spout once the spout flap has been removed.

Examples of the invention seek to solve, or at least ameliorate, one or more disadvantages of previous systems of dispensing flowable product, such as water and the like.

According to a first aspect of the present invention, there is provided a package comprising a carton and a flexible bag to contain a flowable product, the bag having a dispensing outlet for dispensing the flowable product, the carton having an internal wall defining to one side of the wall a first cavity within the carton for locating the bag, the internal wall having an opening within which a body of the dispensing outlet is located whereby an outer end of the dispensing outlet lies within a second cavity defined between an opposite side of the internal wall and an adjacent external wall of the carton, the carton including a removable area leading into the second cavity to expose the dispensing outlet and provide access thereto.

According to a preferred embodiment, the removable area is at least partially within the adjacent external wall. Preferably, the removable area is wholly within the adjacent external wall. Preferably, the removable area is partially within the adjacent external wall and partially within a further external wall which is transverse to the first said adjacent wall.

According to a preferred embodiment, one of the external walls of the carton has a further removable area leading into the first cavity to expose the bag and provide access thereto.

According to a preferred embodiment, the removable area has at least one finger opening. Preferably, the further removable area has a finger opening. Preferably, the removable area and/or further removable area has perforations to aid the removal process. Preferably, one of the external walls has perforations extending from opposing sides of the further removable area to assist in removing the bag.

According to a preferred embodiment, the carton has fixing means for retaining the body of the dispensing outlet in the opening of the internal wall.

Preferably, the dispensing outlet is a spout. More preferably, the dispensing outlet has a removable cap.

In an embodiment, wherein the dispensing outlet is closable by a removable valve. The valve can be a tap.

According to an embodiment, the removable valve has a tubular member having an open end portion arranged to attach over a dispensing outlet of the flexible bag to allow contents of the bag to flow into the tubular member, the interior of the tubular member having a transverse wall including a flexible diaphragm, and a dispensing opening normally closed by the flexible diaphragm and a lever extending laterally on an outer side of the wall and connected to the flexible diaphragm to displace the diaphragm from a position where the flexible diaphragm sealably closes the dispensing opening preventing the contents from exiting the bag and a position where the flexible diaphragm is removed from the dispensing opening permitting the contents of the bag to exit thereby, and wherein the open end portion is arranged to be attachable to the dispensing outlet by a threaded connection.

According to an embodiment, the open end portion is directly attached to the dispensing outlet.

According to an embodiment, the open end portion is attached to the dispensing outlet via a thread tubular connection piece coupled to the tubular member.

The dispensing outlet can have a valve. In a preferred embodiment, the dispensing outlet has a removable cap having an integrated valve. As an example, the valve can be a tap.

In a second aspect of the present invention, there is provided an apparatus for dispensing and cooling flowable product from a package as described above, the apparatus having cooling or heating means wherein the cooling or heating means is arranged to cool or heat said contents of the bag in the package.

Preferably, the apparatus has structure for receiving the package thereon, wherein the cooling means comprises a raised cooling or heating portion arranged to project into the first cavity of the package when it is so received by the structure such that the raised cooling portion is contactable with the bag via an access opening in the package.

Preferably, the access opening can be provided by removing the further removable area.

According to a third aspect of the present invention, there is provided an apparatus for dispensing flowable product from a package as described above, the apparatus having pumping means connectable to the package via the dispensing outlet for feeding the drawn flowable product of the package to a dispensing outlet of the apparatus.

According to a preferred embodiment, the apparatus can have cooling means for cooling the drawn flowable product. The apparatus can have heating means for heating the drawn flowable product.

Preferably, the apparatus has an enclosure configured so as to house the pumping means and at least one package. The enclosure can have a door, the door being openable so as to permit removal and insertion of the package(s).

Preferably, the at least one package is housed in a lower part of the enclosure and the dispensing outlet of the apparatus is in an upper part of the apparatus. The apparatus can be floor-mountable. The apparatus can be free-standing.

According to a fourth aspect of the present invention, there is provided a system for cooling flowable product having an apparatus as described above and a package as described above According to a fifth aspect of the present invention, there is provided a valve for dispensing flowable product contained in a flexible bag, the valve having a tubular member having an open end portion arranged to attach over a dispensing outlet of the flexible bag to allow contents of the bag to flow into the tubular member, the interior of the tubular member having a transverse wall including a flexible diaphragm, and a dispensing opening normally closed by the flexible diaphragm and a lever extending laterally on an outer side of the wall and connected to the flexible diaphragm to displace the diaphragm from a position where the flexible diaphragm sealably closes the dispensing opening preventing the contents from exiting the bag and a position where the flexible diaphragm is removed from the dispensing opening permitting the contents of the bag to exit thereby, and wherein the open end portion is arranged to be attachable to the dispensing outlet by a threaded connection.

According to an embodiment, the open end portion is directly attached to the dispensing outlet.

According to an embodiment, the open end portion is attached to the dispensing outlet via a thread tubular connection piece coupled to the tubular member.

The present invention will now be described, by way of non-limiting example only, with reference to the accompanying drawings, in which.

Figure 1:
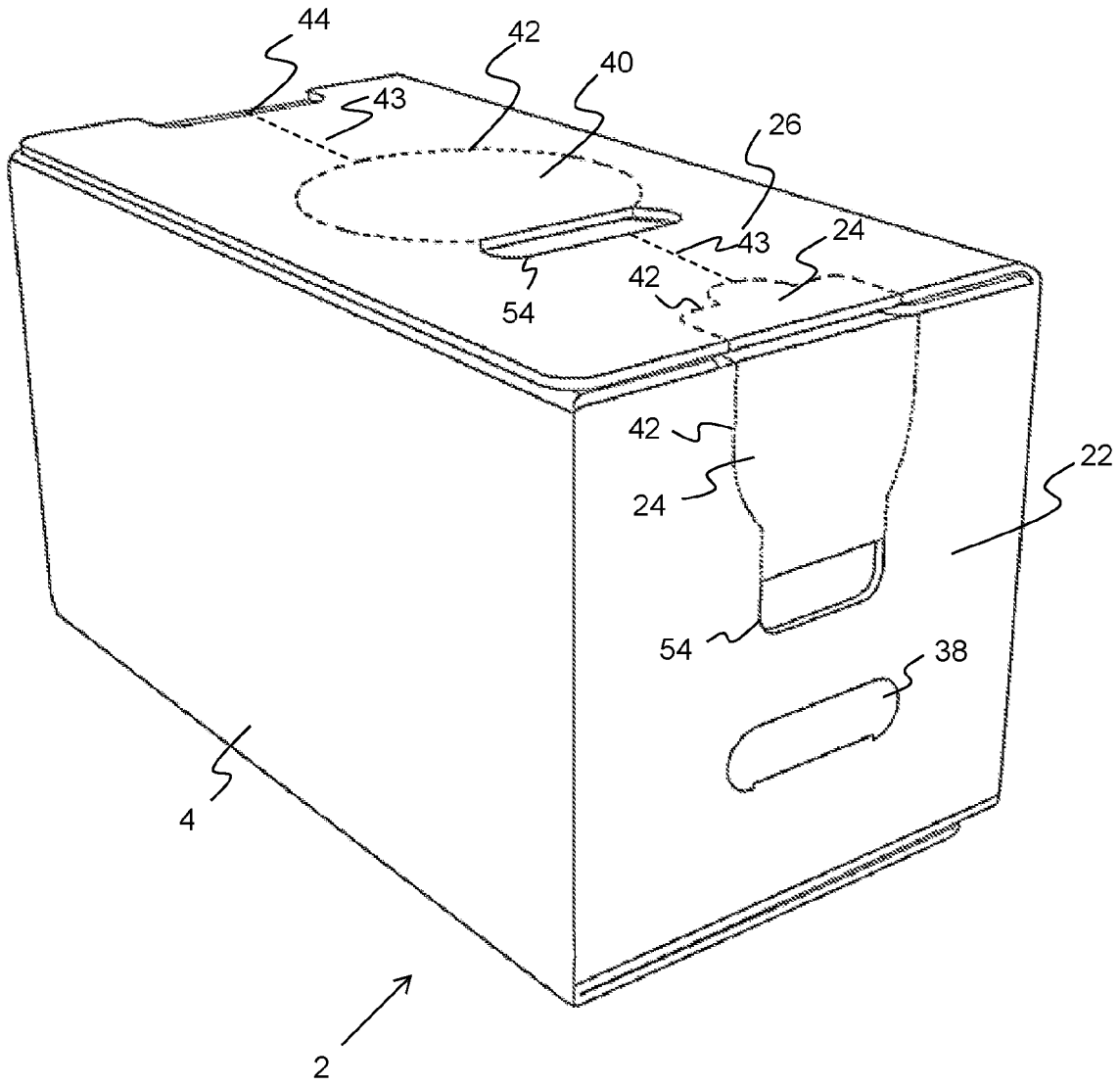
FIG. 1 shows a perspective view of a package according to a preferred embodiment of the present invention.
Figure 11A:
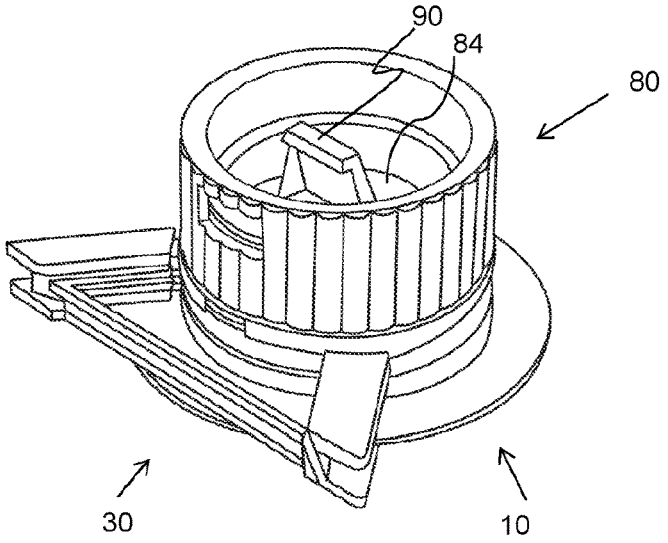
Figure 11B:
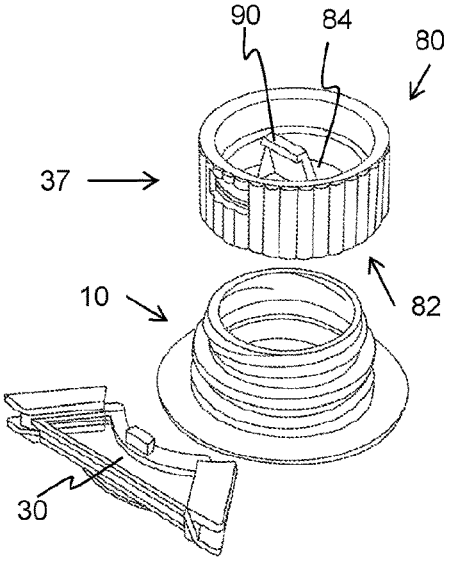
Figure 11C:
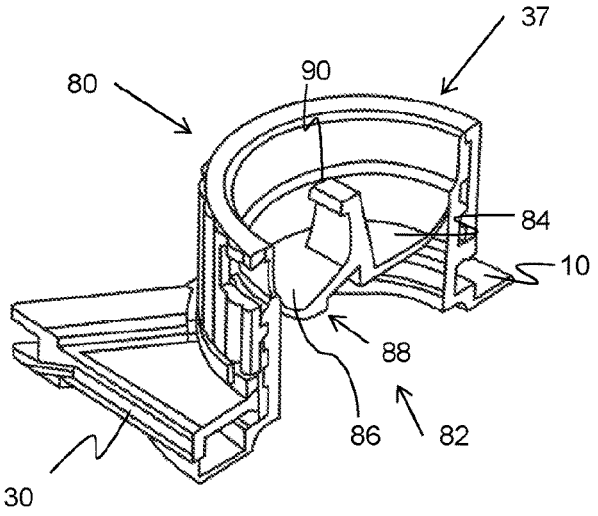
Figure 12A:
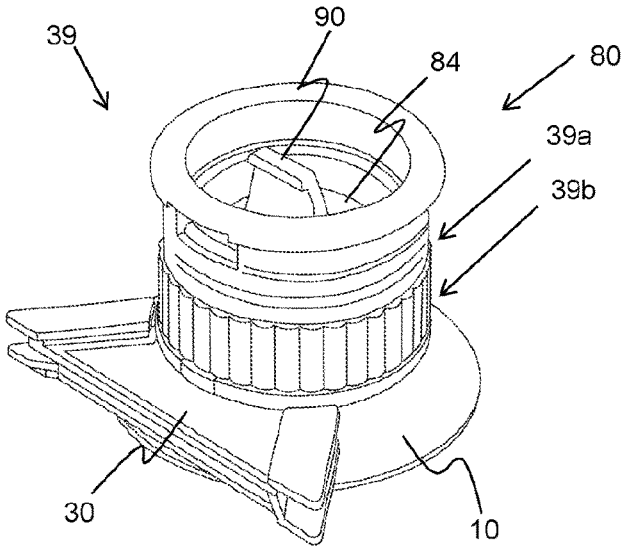
Figure 12B:
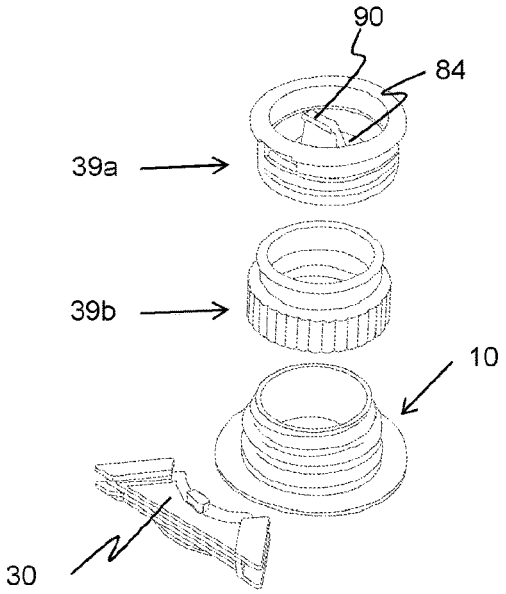
Figure 12C:
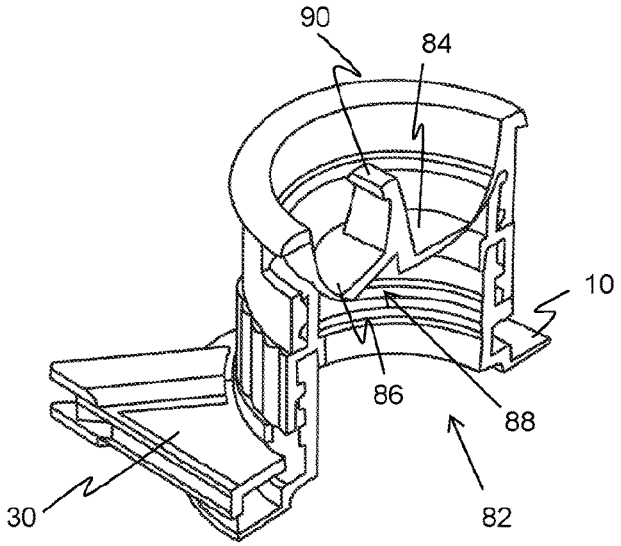

FIGS. 11*a* to 11*c* are perspective, exploded and cross-section views of a first embodiment of an alternative removable valve to be used with the package of FIG. 1; and FIGS. 12*a* to 12*c* are perspective, exploded and cross-section views of a second embodiment of the alternative removable valve to be used with the package of FIG. 1.

With reference to FIGS. 1 to 5, there is shown a carton 4, the carton 4 being configured to receive a flexible bag to contain liquid 8 therein. The bag has a dispensing outlet 10, which can be defined as a spout, for dispensing the liquid 8 such that the carton 4 and the bag define a package 2 for containing and dispensing liquid according to a preferred embodiment of the present invention.

The bag can be a conventional flexible bag being formed of substantially impermeable material suitable for use with flowable products that require storage and dispensing. The flowable products can include dry or liquid flowable products, being of the sort that readily flow under gravity. Examples of liquid flowable products include chemicals or chemically based products such as cosmetics, inks, paints, solvents, adhesives as well as liquid consumable products including oil, beverages and condiments such as soy sauce, fish sauce, vinegar and the like. Examples of dry flowable products can include powdered or granular materials, such as detergents, salt, sugar or grains. As an example, the embodiments herein have been described to contain and dispense liquid however the person skilled in the art would understand that the embodiments could be used with any suitable flowable product. The bag can be sized to accommodate any capacity as desired but in these embodiments the bag can have a capacity of 10 to 15 Litres. Accordingly, the carton 4 is sized to accommodate the bag.

The carton 4 has an internal wall 12, the internal wall 12 defining to one side of the wall a first cavity 13 within the carton 4 for locating the bag. The internal wall 12 has an opening 14 in which a body 16 of the spout 10 is located whereby an outer end 18 of the spout 10 lies within a second cavity 20 defined between an opposite side of the internal wall 12 and adjacent external wall 22 of the carton 4. The carton 4 has a removable area 24 leading into the second cavity 20 to expose the spout outer end 18 and provide access thereto. This provides the advantage that the user can easily locate the spout outer end 18 within the second cavity 20 once the removable area 24 has been removed. Further, if the user uses a sharp object to remove the removable area 24, as the spout outer end 18 is isolated from the bag by the internal wall 12, it is much less likely that the bag will be pierced by the sharp object.

In the described embodiments, the removable area 24 is partially within the adjacent external wall 22. The removable area 24 can also be located partially within a further external wall 26 transverse to the adjacent external wall 22. This provides easy access to the spout outer end 18. In an example, the removable area 24 can be wholly within the adjacent external wall 22.

Figure 3:
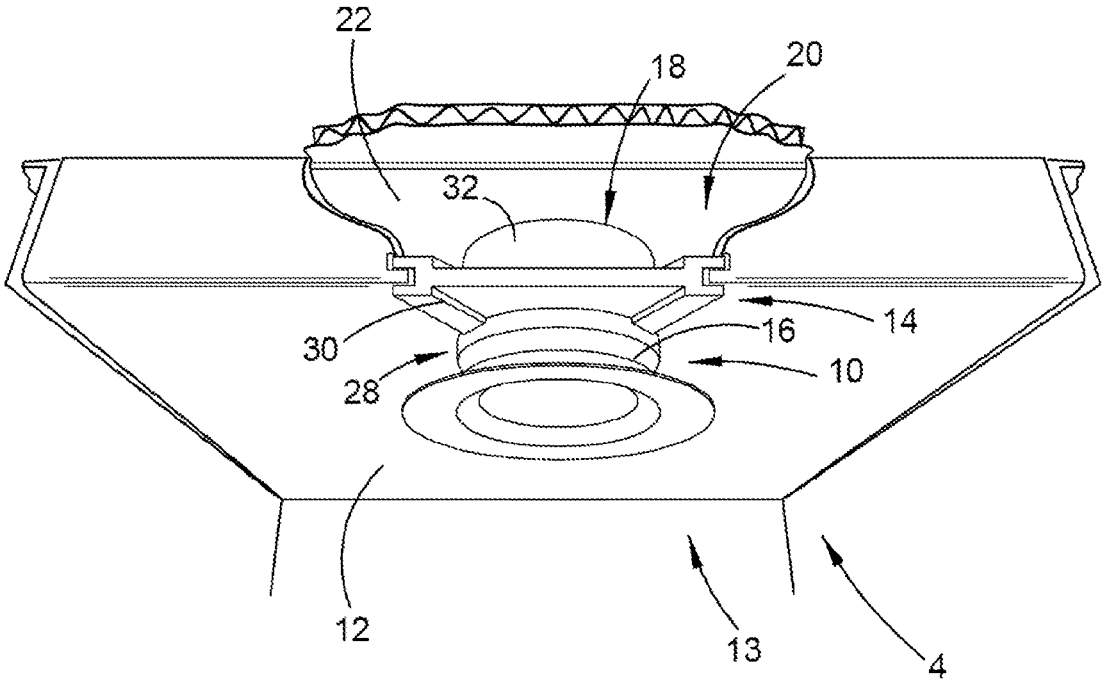
FIG. 3 shows a perspective view from within the carton of a spout in the carton of FIG. 2.
Figure 4:
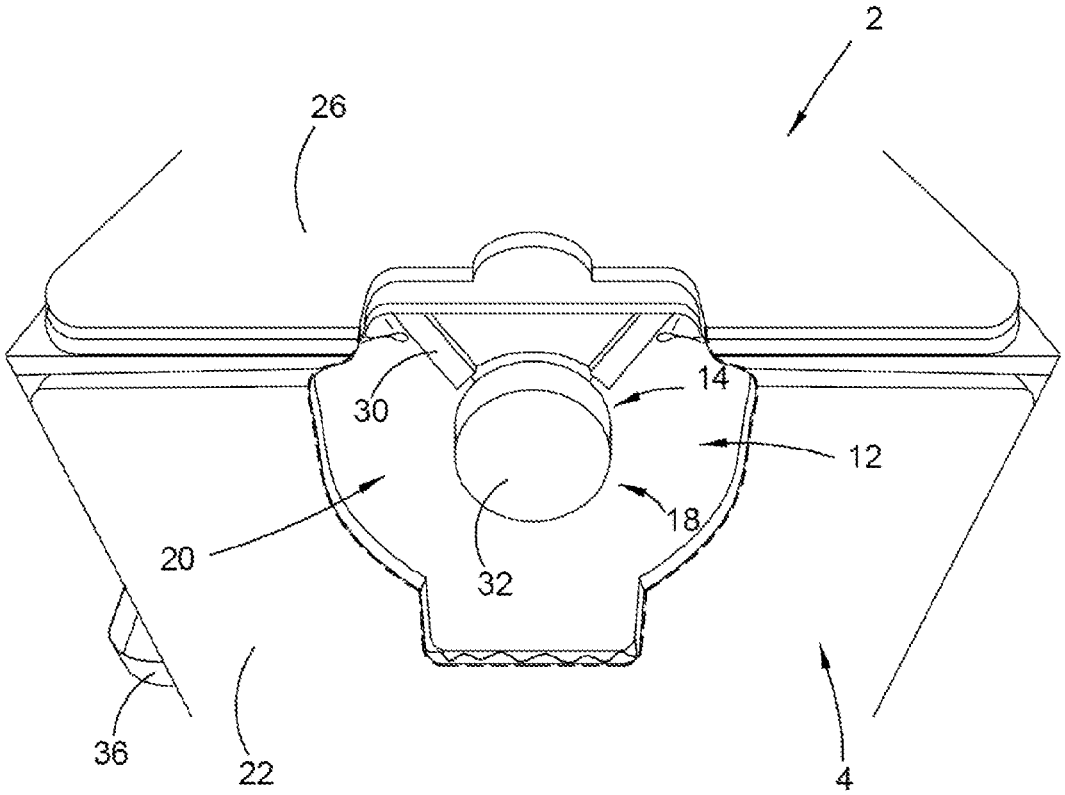
FIG. 4 shows a perspective view from without the carton of the outer end of the spout of FIG. 3.
Figure 10:
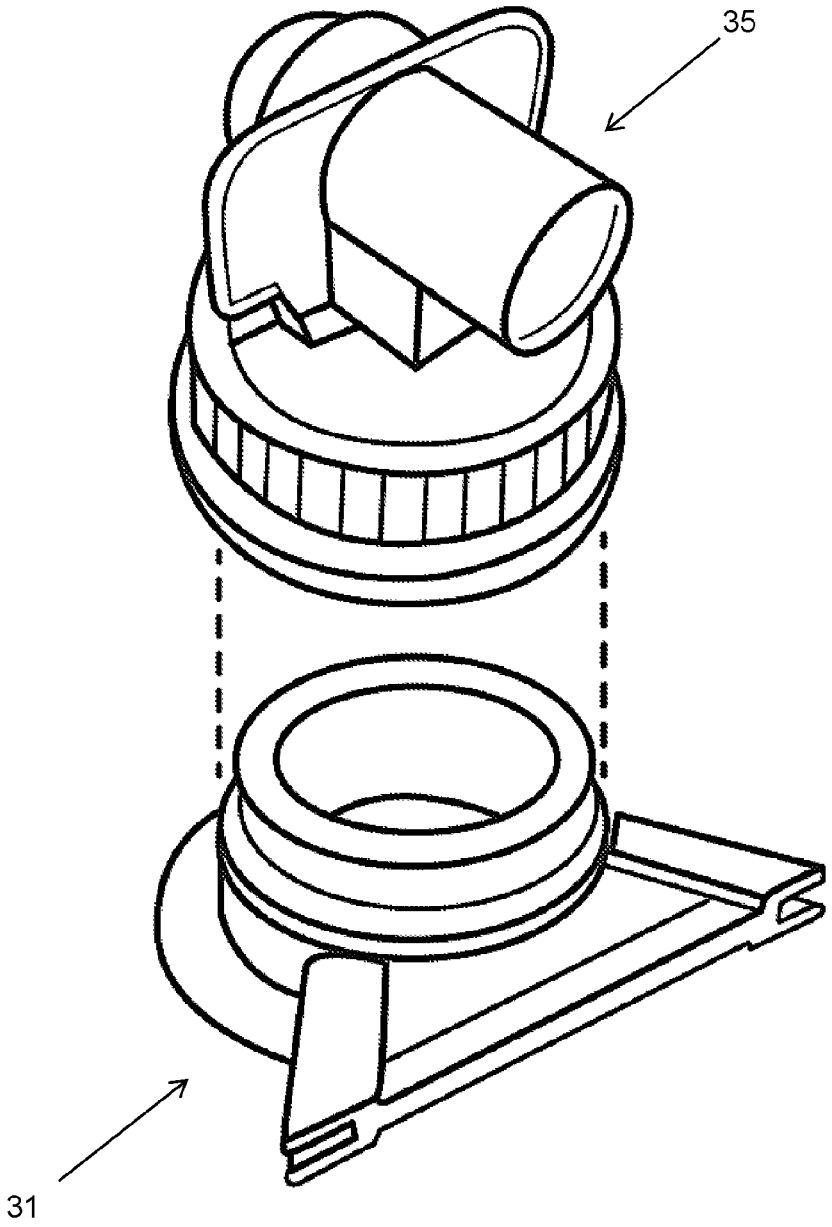
FIG. 10 shows an embodiment of a spout having an integrated support portion and a removable cap with an integrated tap to be used with the package of FIG. 1.

With regard to FIGS. 3 and 4, the opening 14 of the internal wall 12 has a recess 28 into which part of the spout body 16 can be fittingly received. The internal wall 12 can have fixing means for fixing the spout body 16 in the recess 28. The fixing means can be defined as a support portion 30 within the internal wall 12. The support portion 30 is arranged to extend between the spout body 16 and an adjacent edge of the internal wall 12 such that the recess 28 and support portion 30 circumferentially surround the spout body 16. The support portion 30 can itself be fastened within the internal wall 12, for example by adhesive. Accordingly, the spout body 16 is securely retained in the internal wall 12 without regard to an orientation of the package 2. In a preferred embodiment, the support portion 30 and spout body 16 can be formed as a single unit 31, shown in FIG. 10. Therefore, the user does not need to reach into the carton 4 to find the spout outer end 18 and to re-orient it for use.

Figure 5:
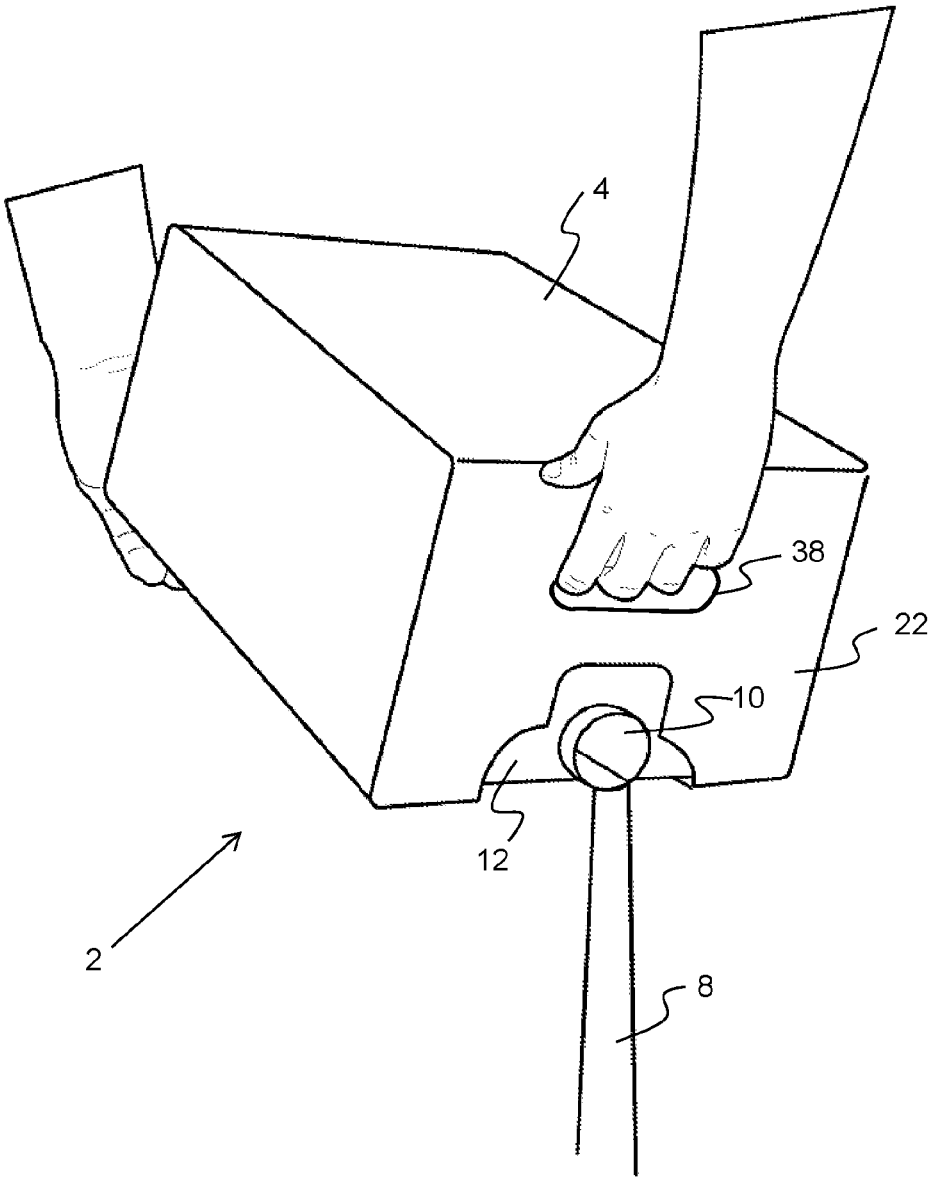
FIG. 5 shows a perspective view of a user dispensing flowable product from the package of FIG. 1.

The spout outer end 18 can have a removable cap 32 or a removable valve 34. According to the embodiments shown in FIGS. 3, 4 and 7, the cap 32 can be attachable by a screw and thread arrangement, and a corresponding removable tap 34 can be exchanged for the cap 32 to dispense the liquid 8. Alternatively, as shown in FIG. 5, the liquid 8 can be dispensed directly from the package 2 via the spout 10 without the use of a tap 34. Although the second cavity 20, in FIGS. 3 and 4, is sized to accommodate the height of the cap 32, the second cavity 20 may be configured to house a tap 34, either fixed to the bag or removable from the bag such as a removable tap or valve (see FIGS. 7, 11*a* to 11*c* and 12*a* to 12 *c*). In a preferred embodiment, the spout 10 can have a removable tap 34, 35 or valve 37, 39 so that the liquid 8 can be accessed via the spout 10 directly by removing the removable cap 32, or valve 37, 39 or dispensed by the tap/valve 34, 35, 37, 39 directly.

The removable valve 37, as exemplified in FIGS. 11*a* to 11*c* and 12*a* to 12*c*, has a tubular member 80 having an end portion 82 being open and further being arranged to attach over the dispensing outlet 10 of the flexible bag (not shown) to allow the contents of the flexible bag to flow into the tubular member 80. The interior of the tubular member 80 has a transverse wall 84, the wall 84 including a flexible diaphragm 86, a dispensing opening 88 normally closed by the flexible diaphragm 86. The wall also includes a lever 90 extending laterally on an outer side of the wall 84 and connected to the flexible diaphragm 86 to displace the flexible diaphragm 86 from a position where the flexible diaphragm 86 sealably closes the dispensing opening 88 preventing the contents from exiting the bag and a position where the flexible diaphragm 86 is removed from the dispensing opening 88 permitting the contents of the bag to exit. The lever 90 is connected to the flexible diaphragm 86 such that the flexible diaphragm 86 is operable between these two positions by manipulation of the lever 90. The open end of the tubular member 80 is arranged to be attachable to the dispensing outlet 10 by a threaded connection, for example, the internal wall of the open end portion 82 has a thread arranged to be engageable to a corresponding thread on the outer wall of the dispensing outlet 10.

In FIGS. 11*a* to 11*c*, the removable valve 37 is directly attached to the dispensing outlet 10. However in FIGS. 12*a* to 12*c*, the removable valve 39 comprises two tubular sections 39*a*, 39*b*. The tubular section 39*a* comprising the wall 84 including the flexible diaphragm 86, dispensing opening 88 and lever 90, is couplable to the dispensing outlet 10 via a threaded tubular section 39*b* coupled to the lever 90 as described above. The two sections 39*a*, 39*b* are couplable by a snap-fit connection. Having the valve 39*a* attachable via the threaded tubular connection piece 39*b* increases the ease at which the sections 39*a*, 39*b* can be manufactured in comparison to the embodiment of the single piece removable valve 37 exemplified in FIGS. 11*a* to 11*b*.

In another embodiment, the package 2 can be provided with at least one handle 36. The handle 36 can be defined by a hand opening 38 formed as a cut-out within one of the external walls of the carton 4. The carton 4 can be provided with a pair of hand openings 38 on opposing external carton walls so that a user may carry the package 2 with both hands. Alternatively, or additionally, the handle 36 could be formed of a strap-like material, such as plastic, cloth or rope. The handle ends can be attached to edges of opposing external walls such that the body of the handle 36 extends over an end of the package 2, as shown in FIG. 4.

According to a preferred embodiment, one of the external walls 26 of the carton 4 has a second removable area 40. The second removable area 40 leads into the first cavity 13 thereby forming a bag access opening to expose the bag and provide access thereto for cooling purposes as will be described below.

The removable areas 24, 40 can have perforations 42 to aid in the removal process. The removable areas 24, 40 have a finger opening 54, one within each external wall 22, 26 thereby allowing the removable areas 24, 40 to be grasped easily, so that the removable areas 24, 40 can be removed by lifting the removable areas 24, 40 and tearing along the perforations 42.

As shown particularly in FIG. 4, the removable areas 24, 40 comprise a single external layer of cardboard, the inner layers of cardboard beneath the removable areas 24, 40 having respective cut-outs 25, 41 corresponding to the removable areas 24, 40, which allows the removable areas 24, 40 to be easily torn along the perforations 42. The cut-outs 25, 41 are arranged so as to be slightly smaller than the respective removable areas 24, 40, such that the inner walls of the carton 4 support the perforations 42 thereby preventing the removable areas 24, 40 from being inadvertently torn or from collapsing inwardly during transport or handling.

Figure 2:
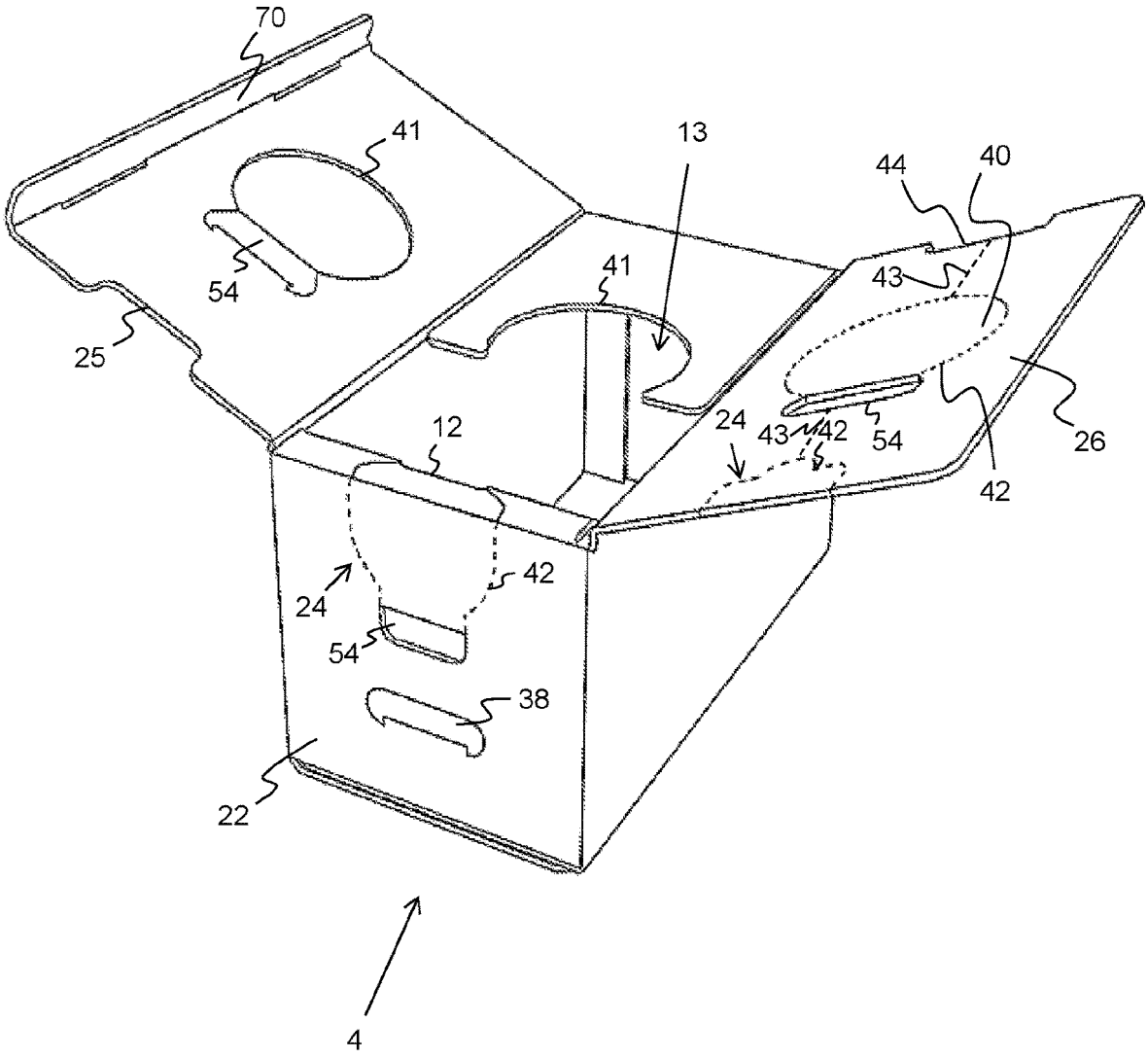
FIG. 2 shows a perspective view of a partially open carton of the package of FIG. 1.

Additional perforations 43, as exemplified in FIGS. 1 and 2, can be provided in the external layer of cardboard, the perforations 43 extending between the removable areas 24, 40, and recessed hand portion and finger opening 54 respectively. These perforations 43 assist the user to break the external layer of cardboard to allow the bag to be assessed such that the bag can be inserted into a separate dispensing device (not shown) or alternatively the bag can be removed so that the package 2 can be separated for recycling purposes.

Figure 6:
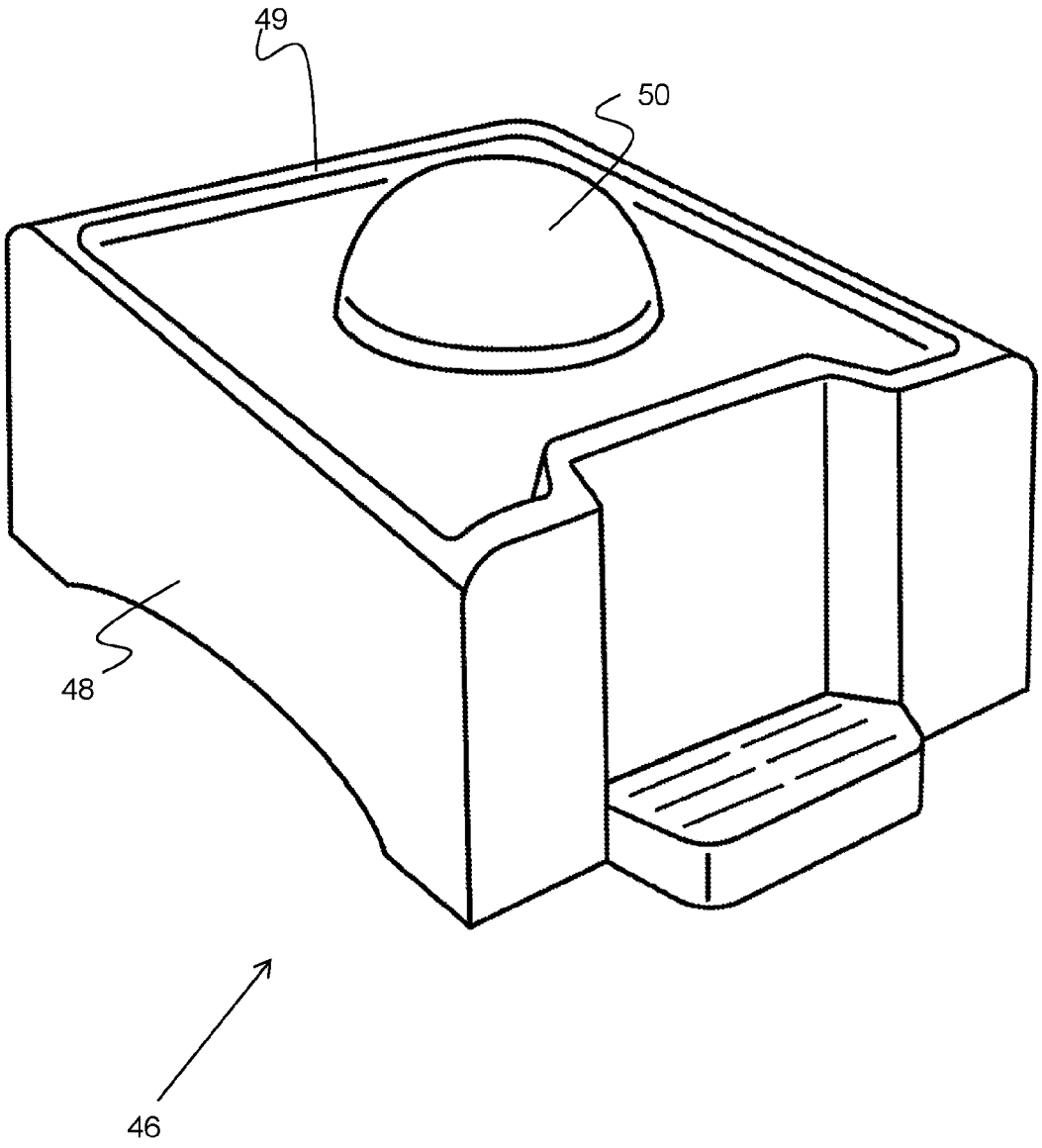
FIG. 6 shows a perspective view of an apparatus for dispensing flowable product from the package of FIG. 1, according to an embodiment of the present invention.
Figure 7:
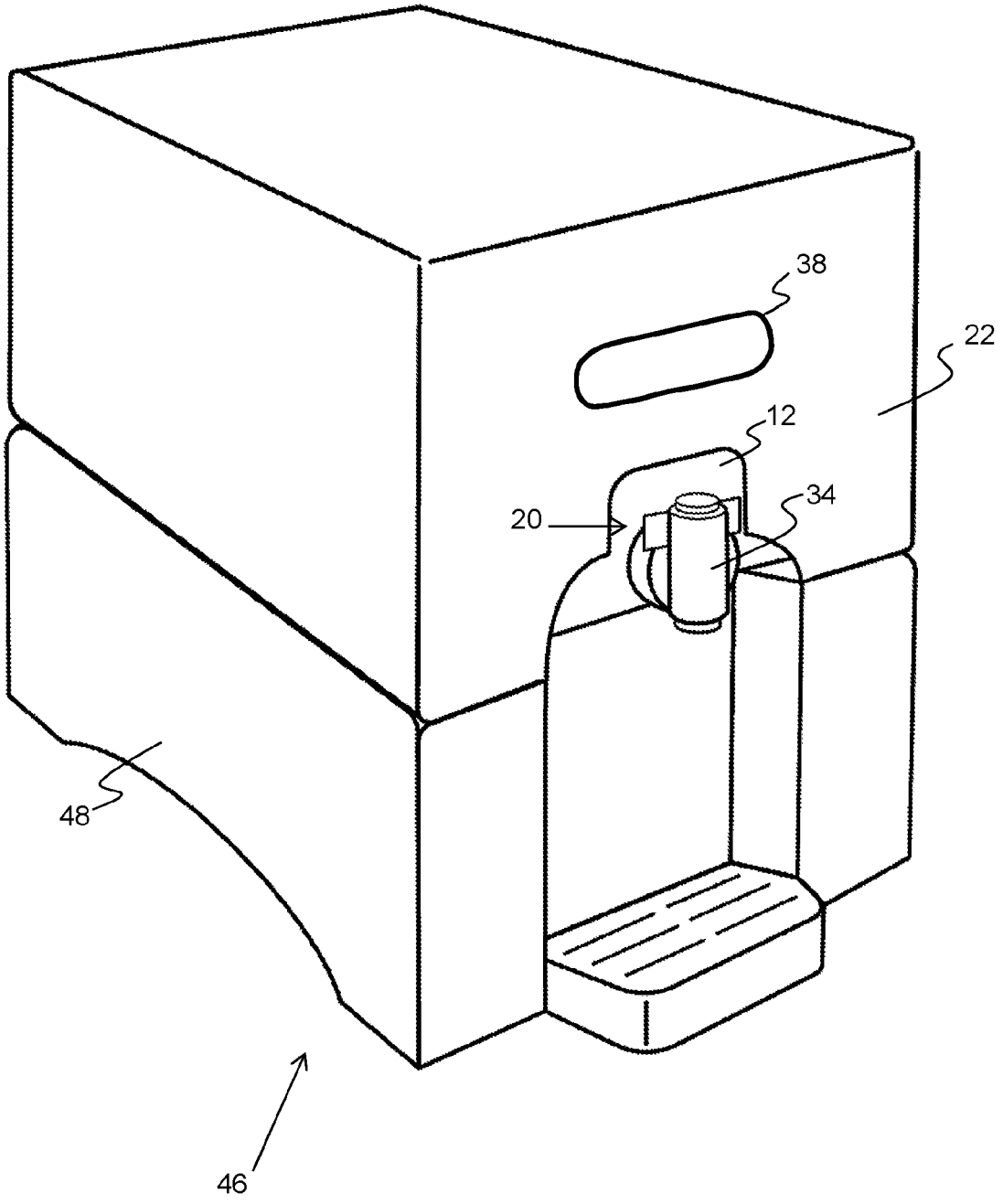
FIG. 7 shows a perspective view of the package of FIG. 1 on the apparatus of FIG. 6.
Figure 8:
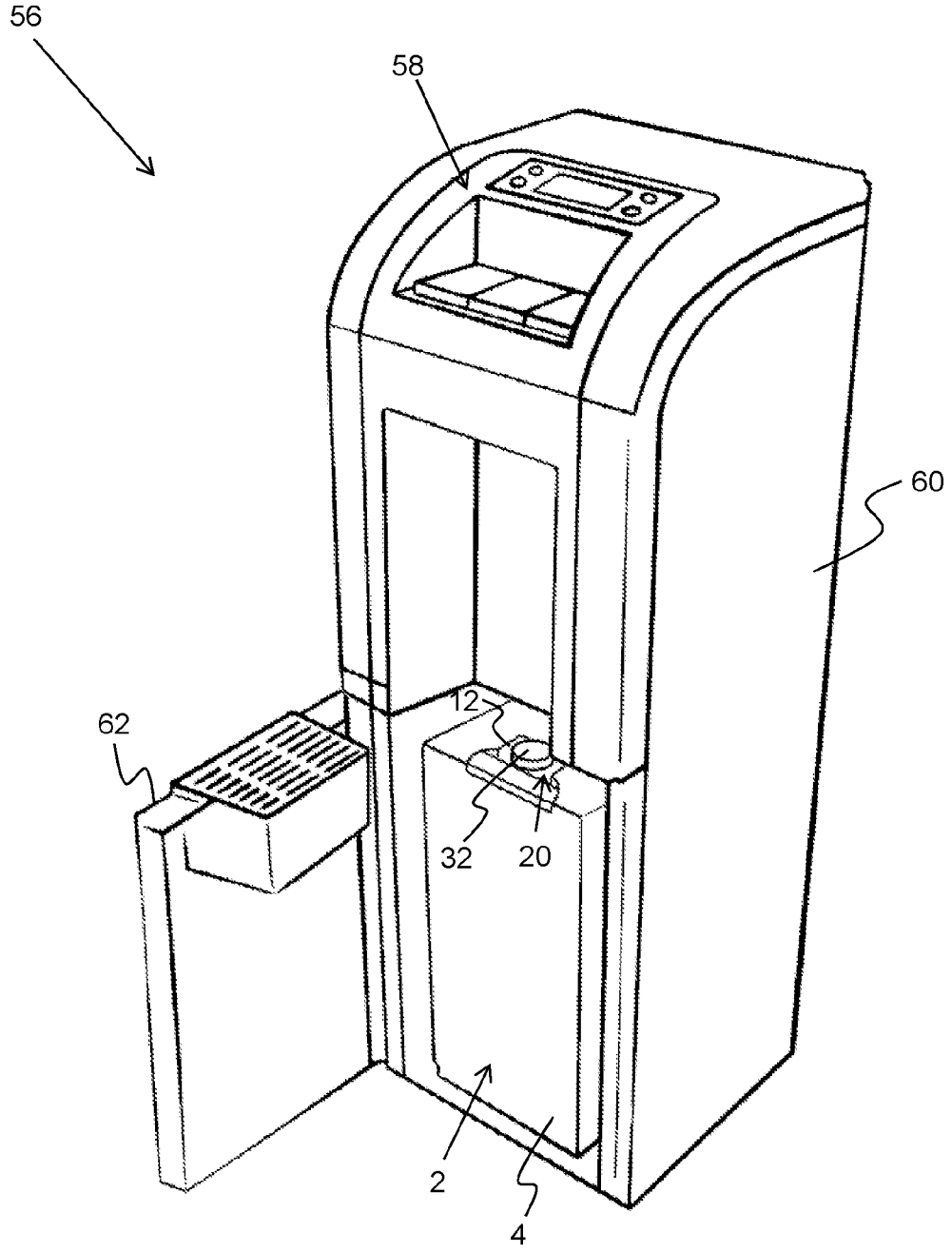
FIG. 8 shows a perspective view of an apparatus for dispensing flowable product, according to another embodiment of the invention, from the package of FIG. 5.

The package 2 can be configured to be used with an apparatus for dispensing liquid 46, as shown in the embodiment of FIGS. 6 and 7. The apparatus 46 has cooling or heating means 50, which is arranged to cool or heat the contents of the bag. The apparatus 46 has a structure 48 for receiving the package thereon. The cooling or heating means 50 has a raised cooling or heating portion 50 which is configured to project into the first cavity 13 of the package 2 when the second removable area 40 has been removed and the package 2 is received on the structure 48, whereby, the bag being filled with liquid 8, conforms to the shape of the raised cooling or heating portion 50 directly contacting and efficiently cooling or heating the contents of the bag. In a preferred embodiment, the raised cooling or heating portion 50 has a dome-like shape. The cut-outs 41 within the inner layers of the carton 2 beneath the further adjacent external wall 26 has a smaller diameter than the removable area 40 to assist in supporting the weight of the package 2 when it is in contact with the raised cooling or heating portion 50.

The structure 48 is arranged to hold the package 2 such that the spout 10 is spaced above a surface, such as a counter-top, such that a vessel can be conveniently placed beneath the valve 34 to capture the dispensed liquid 8. The structure 48 can have a sloping top surface 49 whereby, when the package 2 is received on said surface 49, the dispensing outlet end of the package 2 is lower than the opposite end such that the contents of the bag settle at the dispensing outlet end thereby assisting the contents to drain from the package 2 without additional manipulation.

In an example use of the apparatus 46, the user inserts a finger or thumb into the finger openings 54 of the first and second removable areas 24, 40 tearing along the perforations 42 thereby exposing both the spout outer end 18 in the second cavity 20, which is closed by a removable cap 32, and the bag in the first cavity 13. The removable cap 32 can then be replaced by a valve 34. As illustrated in FIG. 5, the user can then dispense liquid 8 directly from the package 2, first grasping the package 2 by a hand opening 38 and a recessed hand portion 44 on an edge of external wall 26, and tipping the package 2 so that the liquid 8 flows from the spout outer end 18 by the action of gravity.

According to another embodiment of the invention, there is shown an apparatus 56 for dispensing liquid 8, the apparatus 56 having pumping means (not shown) connectable to the package 2 via the dispensing outlet 10 of the package 2. The apparatus 56 has a dispensing outlet 58 for dispensing the drawn liquid 8 fed to it by the pumping means and an enclosure 60 configured to house at least one package 2, the dispensing outlet 58 and pumping means. The enclosure 60 can be arranged with a door 62, the door 62 being openable and closable to allow removal and insertion of the package(s) 2. The at least one package 2 is housed in a lower part of the enclosure 60 and the dispensing outlet 58 is in an upper part of the apparatus 56 to form an upright configuration. Such an upright configuration allows the apparatus 56 to be floor-mountable. In a preferred embodiment, the apparatus 56 can be free-standing.

In an example use of the apparatus 56, the user easily removes the removable area 24 by inserting fingers into the finger opening 54, grasping and lifting the removable area 24 and tearing along the perforations 42 to expose the spout outer end access area. The pumping means can have a hose (not shown), which can extend from within the enclosure 60, to be inserted into the spout 10 when the removable cap 32 (or removable cap having an integrated valve 35 or attachable valve 34) is detached, to feed the drawn liquid 8 to the dispenser outlet 58 of the apparatus 56 via the pumping means from the bag. The package 2 can then be placed into the enclosure 60 via the door 62. The liquid 8 can be heated or cooled, as desired before dispensing.

Figure 9:
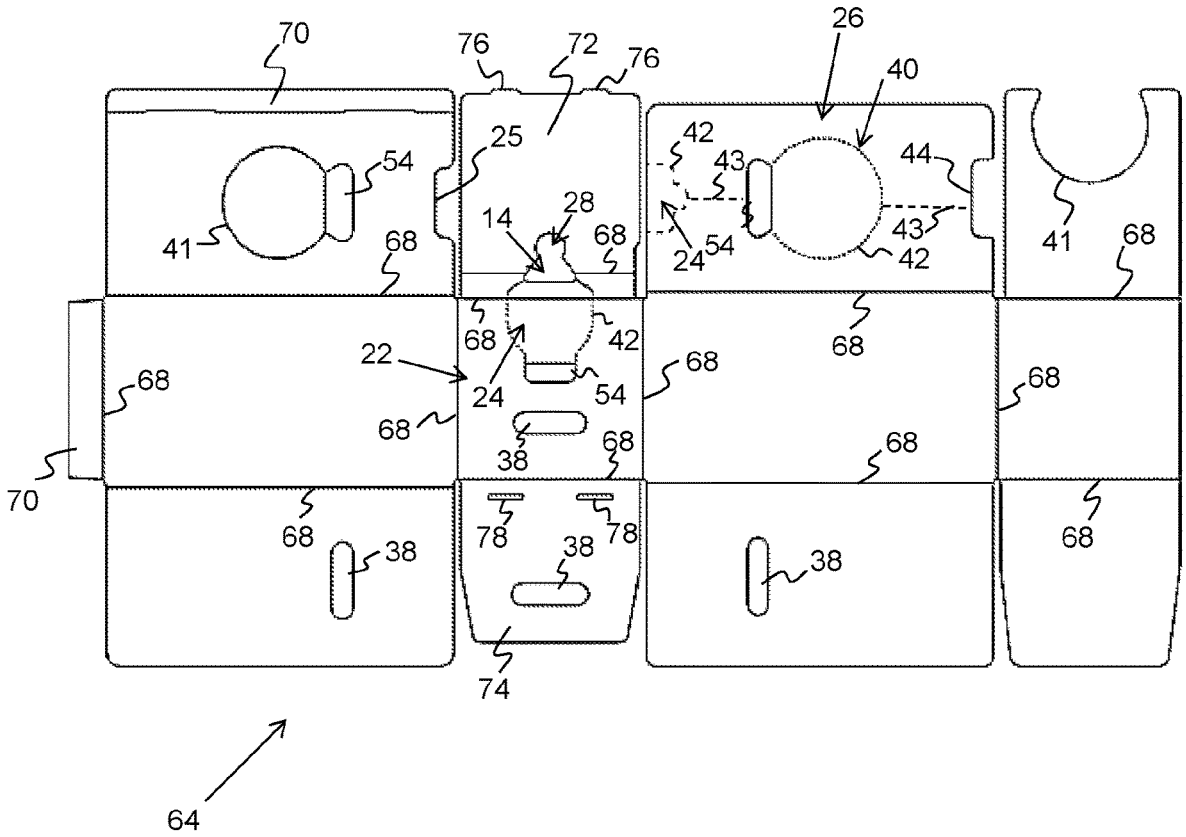
FIG. 9 shows an example blank which can be used to form the carton of FIGS. 1 to 4.

FIG. 9 shows an example blank 64 for a carton 4 formed of a cardboard material, the carton 4 being formed by bending the blank 64 along the fold lines 68 and gluing the flaps 70. The dotted lines represent perforations 42, which define the removable areas 24, 40. The adjacent external wall 22, as illustrated in FIG. 9, has a pair of flanges 72, 74, each flange 72, 74 extending from opposing edges of the adjacent external wall 22. One of the flanges 72 is foldable and has tabs 76 that are securable in the slots 78 of the other flange 74 such that a part of the flange 72 is parallel to and spaced apart from the adjacent external wall 22 thereby defining the second cavity 20. It can be understood by a person skilled in the art that this is an example blank for the carton 4 as described above and many embodiments of this blank can be configured so as to produce such a carton 4.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The claims defining the invention are as follows:

1. A package comprising a carton and a flexible bag to contain a flowable product, the bag having a dispensing outlet for dispensing the flowable product, the carton being formed of a blank of a single sheet of sheet material having portions separated by fold-lines and foldable to form front, back, top, bottom and side panels of the carton when erected;

the front panel of the carton having an external wall and at least one flange integrally formed with the external wall and extending from an edge thereof to be foldable behind the external wall to form an internal wall spaced apart from the external wall, the internal wall defining to one side thereof a first cavity within the carton for locating the flexible bag and to the opposite side thereof a second cavity formed between the internal wall and the external wall;

the internal wall having an opening within which a body of the dispensing outlet is located such that an outer end of the dispensing outlet lies within the second cavity; and the external wall including a removable area leading into the second cavity to expose the dispensing outlet and provide access thereto.

2. The package according to claim 1, wherein the removable area is at least partially within the adjacent external wall.

3. The package according to claim 1, wherein the removable area is wholly within the adjacent external wall.

4. The package according to claim 1, wherein the removable area is partially within the adjacent external wall and partially within a further external wall which is transverse to said adjacent external wall.

5. The package according to claim 1, wherein one of the external walls of the carton has a further removable area leading into the first cavity to expose the bag and provide access thereto.

6. The package according to claim 5, wherein the removable area(s) has perforations to aid removal.

7. The package according to claim 1, wherein the internal wall has fixing means for retaining the body of the dispensing outlet in the opening of the internal wall.

* * * * *